United States Patent [19]

Trafton

[11] 4,142,343

[45] Mar. 6, 1979

[54] POST APPARATUS AND METHODS OF CONSTRUCTING AND UTILIZING SAME

[76] Inventor: Ronald H. Trafton, 527 Berry Patch La., Pontiac, Mich. 48054

[21] Appl. No.: 835,008

[22] Filed: Sep. 20, 1977

[51] Int. Cl.[2] ..... E04C 3/32

[52] U.S. Cl. ..... 52/721; 52/738; 256/59

[58] Field of Search ..... 52/721, 738, 737, 730; 256/59, 65; 248/226.3, 226.4

[56] References Cited

U.S. PATENT DOCUMENTS

| | | | |
|---|---|---|---|
| 3,160,249 | 12/1964 | Pavlecka | 52/738 |
| 3,462,110 | 8/1969 | Cheslock | 52/738 |

FOREIGN PATENT DOCUMENTS

| | | | |
|---|---|---|---|
| 1441042 | 6/1976 | United Kingdom | 52/730 |

*Primary Examiner*—James L. Ridgill, Jr.

*Attorney, Agent, or Firm*—Irving M. Weiner; Pamela S. Austin; Melvin Yedlin

[57] ABSTRACT

A maintenance-free anodized aluminum post having longitudinal grooves therein for mating with complementary brackets. The post is hollow and has a constant wall thickness. Each groove has a curved portion and a flat portion. The brackets may be moved in the grooves adjustably, and may be locked to the post without causing any deformation of the post or bracket.

8 Claims, 8 Drawing Figures

POST APPARATUS AND METHODS OF CONSTRUCTING AND UTILIZING SAME

The present invention relates generally to a post apparatus, and to methods of constructing and utilizing such post apparatus.

In particular, the present invention relates to an extruded anodized aluminum post having a tubular configuration with a substantially constant wall thickness, and a plurality of longitudinal grooves in its outer periphery wherein each groove has an arcuate wall portion and an intersecting substantially flat wall portion.

BACKGROUND OF THE INVENTION

Heretofore, posts and support assemblies for privacy fences, boat docks, cyclone fencing, highway signs, and the like, have utilized various devices which are cumbersome, and require relatively frequent maintenance and replacement. While it had been recognized that metallic posts avoid some of the wear and deteriorating properties of wooden posts, special attachments and hardware requirements of suggested metal posts have slowed the use of such posts in the applications mentioned hereinabove.

Various prior art attempts to solve or meliorate the aforementioned problems have proved unsuccessful. The prior art attempts are exemplified by the inventions disclosed in Moore U.S. Pat. No. 3,398,499; Cheslock U.S. Pat. No. 3,462,110; Kiefer U.S. Pat. No. 3,728,837; and U.S. Pat. No. 4,021,973.

The present invention solves the aforementioned problems in a convenient and relatively inexpensive manner.

SUMMARY OF THE INVENTION

The present invention provides an apparatus including an elongated support member having a major longitudinal central axis and an outer periphery which includes at least one groove therein. The elongated support member has a tubular configuration which has a substantially constant wall thickness. The groove is disposed substantially parallel to the major longitudinal central axis of the elongated support member. The groove has an arcuate wall portion and a substantially flat wall portion.

The present invention also provides novel methods of constructing and utilizing the aforementioned apparatus.

It is an object of the present invention to provide a maintenance-free anodized aluminum post structure with complementary mating brackets therefor.

Another object of the present invention is to provide an improved support arrangement for adjustably and releasably supporting a bracket member or the like from a vertically extending support pole member.

A further object of the invention is to provide a fence post having an integral auger at the bottom thereof for rotating the post into frozen or hard terrain.

An additional object of the invention is to provide an extruded tubular post support member having a substantially constant wall thickness.

A further object of the present invention is to provide a post apparatus having grooves provided with novel re-entry sections facilitating manufacture thereof and ease of adjustably securing therein external bracket members.

Yet a further object of the invention is to provide a post support apparatus which is simply constructed and pleasing in appearance, and which is especially suited for connecting signs and the like.

An additional object of the invention is to provide a metallic post support member wherein brackets are interlocked therewith without the necessity of deforming either the post or the bracket, and without the necessity of the heads of any bolts entering any of the grooves of the post.

Another object of the invention is to provide novel bracket members which may be interchangeably used on posts having different configurations and groove arrangements.

The foregoing and other objects and advantages of the present invention will become apparent from the ensuing disclosure in which several preferred embodiments of the invention are described in detail and illustrated in the accompanying drawings in which like parts are designated by like reference numerals. It is contemplated that minor variations in structural features and arrangement of parts thereof may occur to the skilled artisan without departing from the spirit of the present invention without sacrificing any of the advantages or objects of the present invention.

DETAILED DESCRIPTION

Before explaining the present invention in detail, it is to be understood that the present invention is not limited in its application to the details of construction and arrangement of parts as illustrated in the accompanying drawings, because the present invention is capable of other embodiments and of being practiced or carried out in various other ways. In addition, it is to be understood that the phraseology and terminology employed is for the purpose of description and illustration only, and not for the purpose of restriction or limitation.

Figure 1:
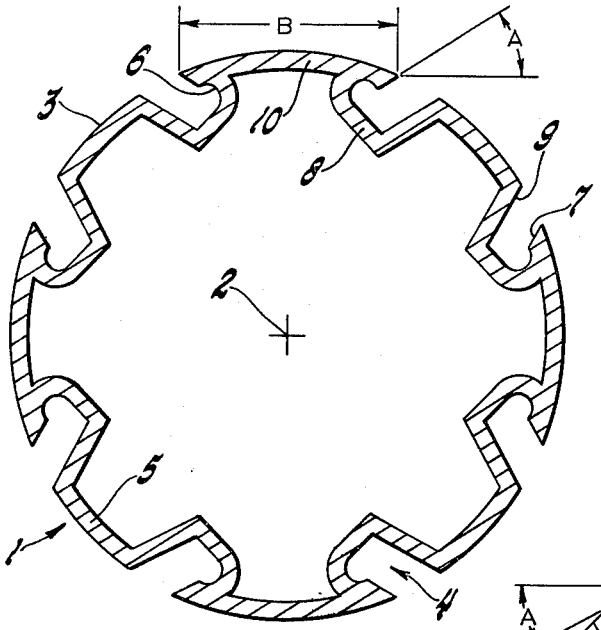
FIG. 1 illustrates a cross-sectional view of a post in accordance with a first possible embodiment of the present invention.

With reference to FIG. 1, there is shown in cross-section an elongated support member or post 1 having a major longitudinal central axis 2 and an outer periphery 3 which includes one or more grooves 4 therein. The post 1 has a tubular configuration which has a substantially constant thickness of its wall 5.

Each of the grooves 4 is disposed substantially parallel to the central axis 2. Each groove 4 has an arcuate wall portion 6 and a substantially flat wall portion 7. The wall portion 7 is disposed in a plane which is oriented askew with respect to the axis 2. In other words, flat wall portion 7 is disposed in a plane to one side of the axis 2, and which does not intersect with axis 2. In particular, it should be noted that the first flat wall portion 7 is constructed to be oriented in a predetermined angle A. In a particular working embodiment of the invention the predetermined angle A has been fixed at approximately 30°.

The groove 4 includes a base portion or base 8 which is disposed in a plane that is oriented substantially perpendicular to a radius emanating from axis 2. It should be noted that no surface or wall portion of the groove 4 is disposed substantially perpendicular to the plane within which the base 8 of that groove is disposed. It should also be noted that the arcuate wall portion 6 intersects the first flat wall portion 7 in an oblique dihedral angle.

Each groove 4 also includes a second substantially flat wall portion 9 which is disposed opposed to and substantially parallel to the first flat wall portion 7. The second flat wall portion 9 intersects the base 8 in an oblique dihedral angle. Although first flat wall portion 7 is parallel to second flat wall portion 9, wall portion 7 does not intersect the base 8, but rather wall portion 7 is separated from base 8 by the arcuate wall portion 6. However, because of the parallel arrangement of flat wall portions 7 and 9, wall portion 7 is disposed in a plane which would intersect base 8 in a similar oblique dihedral angle.

The configuration and dimensions of post 1 are critical to operability and interchangeability of the various components of the present invention. In this connection, attention is directed to the predetermined dimension B of an arcuate wall section 10 forming part of the outer periphery 3 of the post 1. The significance of dimension B of section 10 will become more apparent from the explanation set forth hereinbelow.

Figure 2:
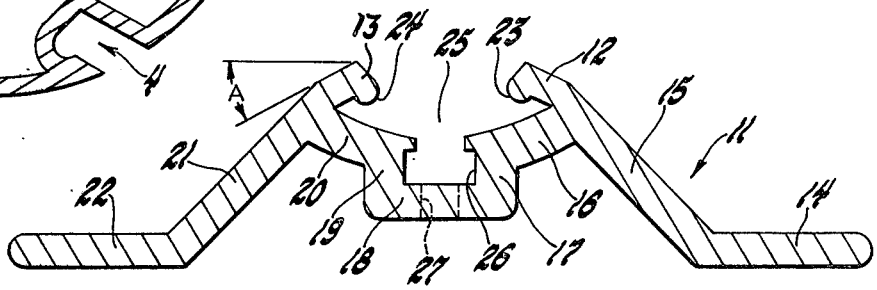
FIG. 2 illustrates a cross-sectional view of a bracket member for mating and interlocking with the post depicted in FIG. 1.

FIG. 2 depicts in cross-section a first bracket member or bracket 11 for mating with and interconnection with the post 1. Bracket 11 has a first arm 12 which is configured and dimensioned to fit within a groove 4 of the post 1. Bracket 11 also has a second arm 13 configured and dimensioned to fit within another groove 4 so that arms 12 and 13 fit within adjacent grooves 4 separated by a wall section 10. Arms 12 and 13 are oriented to converge toward each other.

Bracket 11 includes straight members 14, 15, 17, 18, 19, 21 and 22, arms 12 and 13, and arcuate members 16 and 20. The arms 12 and 13 and the arcuate members 16 and 20 are configured and dimensioned to permit section 10 of post 1 to fit therewithin in order to assemble post 1 and bracket 11. The arcuate space 25 formed in bracket 11 is also formed in part by arcuate portions 23 and 24 at the ends of arms 12 and 13, respectively. The radius of curvature of arcuate portions 23 and 24 is slightly smaller than the radius of curvature of arcuate wall portion 6 of groove 4.

As shown in FIG. 2, members 15 and 21 are not coplanar with arms 12 and 13, respectively. Arms 12 and 13 have a separate angular orientation with respect to numbers 15 and 21, respectively, in order to assure that arms 12 and 13 are oriented to present the same predetermined angle A which is indicated in FIGS. 1 and 2.

As shown in FIG. 2, a box-like cavity 26 is formed between members 17, 18 and 19. Member 18 is provided with an unthreaded hole therethrough which communicates with cavity 26. A bolt (not shown) may be passed through hole 27 to threadedly engage with a nut (not shown) disposed in cavity 26 to rigidly secure bracket 11 to post 1. By tightening the bolt the end of the bolt would bear against the wall section 10 of post 1. As an alternative, in order to eliminate the need for the nut or the formation of cavity 26, there could be provided a threaded hole (such as the one described in connection with FIG. 5) in a continuous arcuate member in lieu of the discontinuous arcuate members 16 and 20.

Figure 3:
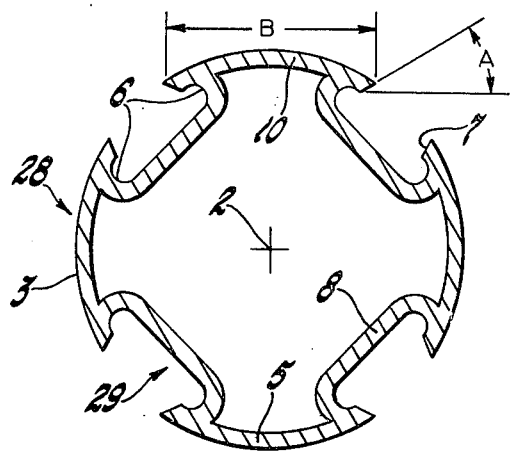
FIG. 3 illustrates a cross-sectional view of a post in accordance with a second possible embodiment of the present invention.

FIG. 3 shows a modified post 28 having grooves 29 which are larger than and configured somewhat different than grooves 4 of post 1. Groove 29 does not have any second flat wall portion 9 such as in groove 4, but groove 29 does have a larger base 8 and diametrically-opposed and oppositely-facing arcuate wall portions 6. The radii of curvature of arcuate portion 6, the predetermined dimension B, and the angular orientation of flat surface 7 in predetermined angle A are identical for posts 1 and 28. The purpose of having posts 1 and 28 configured in this somewhat similar fashion is to permit the bracket 11 to be used interchangeably as desired for post 1 or post 28.

Figure 4:
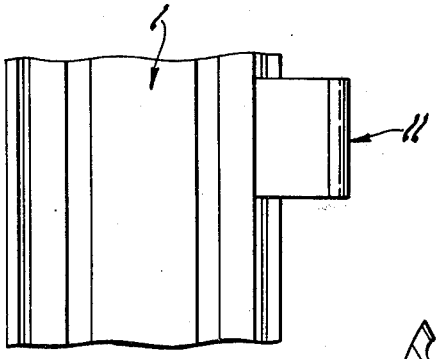
FIG. 4 illustrates a partial elevational view of an assembled bracket and post apparatus in accordance with the present invention.

FIG. 4 shows an elevational view of bracket 11 secured to post 1 (or post 28).

Figure 5:
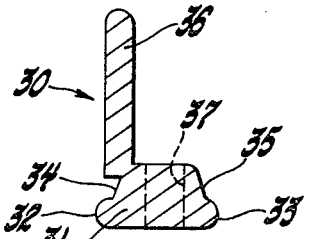
FIG. 5 illustrates a cross-sectional view of a modification of the bracket member.

FIG. 5 shows a second bracket member or bracket 30 for mating with and interconnecting with post 28 by fitting within and occupying substantially the entire space of a groove 29 on post 28. Bracket 30 has a first portion 31 which is configured and dimensioned to fit within groove 29 of post 28. First portion 31 has diametrically-opposed and oppositely-facing arcuate surfaces 32 and 33 each of which conforms substantially to the shape of arcuate wall portion 6 of groove 29.

First portion 31 is also provided with angled surfaces 34 and 35 which conform to the angular orientation of first flat wall portions 7 of groove 29. First portions 31 is integrally connected with lateral member 36 of bracket 30. Member 36 may be connected to or form part of a fence, wall, sign, etc. A threaded aperture 37 extends through first portion 31 for accommodating a threaded bolt (not shown) for securing bracket 30 to post 28.

Figure 6:
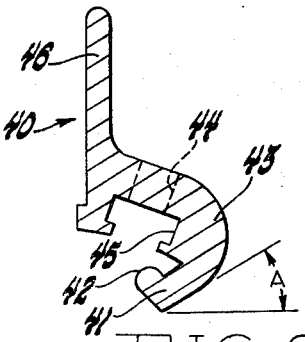
FIG. 6 illustrates a cross-sectional view of another modification of the bracket member.
Figure 7:
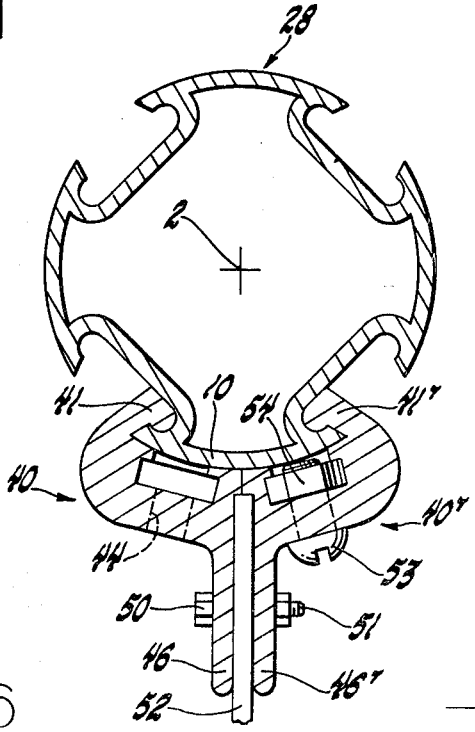
FIG. 7 illustrates a cross-sectional view of an assembly of the FIG. 3 post interconnected to a perpendicularly disposed external member by means of two FIG. 6 brackets.

FIGS. 6 and 7 show a modified third bracket member or bracket 40 for mating with post 1 or 28. Bracket 40 has an arm 41 with an arcuate portion 42 which is configured and dimensioned similar to arm 13 and arcuate portion 24 of bracket 11.

Arm 41 is unitary with a second portion 43 having an unthreaded aperture 44 therethrough and a cavity 45 formed therewithin, similar to the hole 27 and cavity 26 of bracket 11. Portion 43 is unitary and integral with a lateral portion 46 of bracket 40.

FIG. 7 shows a pair of brackets 40 and 40' which may be welded to, or bolted to by bolt 50 and nut 51 to a member 52, such as for example a sign, wall, board, metal plate, etc. The brackets 40 and 40' having the member 52 sandwiched therebetween are shown assembled on and secured to post 28 by means of suitable fastening means, such as a pair of bolts 53 and nuts 54 (only one of each of which is shown).

Figure 8:
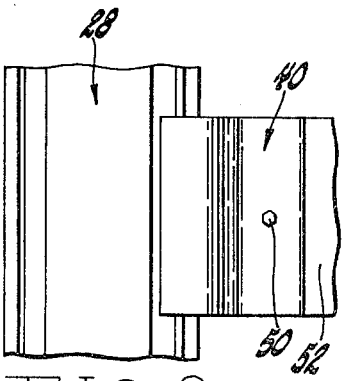
FIG. 8 illustrates a partial elevational view of the FIG. 7 assembly.

FIG. 8 is an elevational view of the FIG. 7 apparatus as assembled.

It should be borne in mind that the brackets 40 and 40' can be used equally for post 28 as well as for post 1.

It should also be borne in mind that the particular dimensions and configurations of the apparatus components described hereinabove is of particular importance to the ease of manufacturing of such components, and also to the adjustability and assembly of the various components.

It should also be noted that the bracket 11 permits the securement of planar members which are either extensions of members 14 and 22 or coplanar therewith, and whereby the post 1 or 28 used therewith is substantially tangent to such coplanar members.

On the other hand, brackets 40 and 40' permit the assembly of a planar member, such as a sign or wall or fence, which is substantially coplanar with the major longitudinal central axis 2 of post 1 or 28.

Bracket 30 permits the assembly of an extension of member 36 or a member coplanar therewith, with respect to a post 28 having its central axis 22 offset from member 36 or any member coplanar therewith.

The present invention also contemplates color coding the apparatus components mentioned hereinabove to coordinate with external members used therewith. For example, post 1 or 28 can be provided in a red color when used in conjunction with redwood boards for fencing or other purposes.

I claim:

1. A post apparatus comprising:

an elongated support member having a major longitudinal central axis and an outer periphery which includes at least one groove therein;

said elongated support member having a tubular configuration which has a substantially constant wall thickness;

said groove being disposed substantially parallel to said major longitudinal central axis of said elongated support member;

said groove having an arcuate side wall portion and a substantially flat side wall portion;

said substantially flat side wall portion of said groove being disposed in a flat plane which is oriented askew with respect to said major longitudinal central axis of said elongated support member;

said groove including a flat base portion which is disposed in a flat plane that is oriented substantially perpendicular to a radius emanating from said major longitudinal central axis of said elongated support member; and none of said side wall portions of said groove of said elongated support member is disposed perpendicular to said flat plane within which said flat base portion of said groove is disposed.

2. An apparatus according to claim 1, including:

at least one third bracket member for mating with and interconnecting with said elongated support member;

said third bracket member having a portion thereof provided with an arcuate shape which is configured and dimensioned to conform to and fit within said arcuate wall portion of said groove.

3. An apparatus according to claim 1, wherein:

said arcuate wall portion of said groove intersects said substantially flat wall portion of said groove in an oblique dihedral angle.

4. An apparatus according to claim 1, wherein:

said groove includes a second substantially flat wall portion which is disposed opposed to and substantially parallel to said first-mentioned substantially flat wall portion of said groove.

5. An apparatus according to claim 1, including:

a first bracket member for mating with and interconnection with said elongated support member;

said first bracket member having a first arm which is configured and dimensioned to fit within a first said groove of said elongated support member;

said first bracket member having a second arm configured and dimensioned to fit within a second said groove of said elongated support member.

6. An apparatus according to claim 1, including:

a first bracket member for mating with and interconnection with said elongated support member;

said first bracket member having a first arm which is configured and dimensioned to fit within a first said groove of said elongated support member;

said first bracket member having a second arm configured and dimensioned to fit within a second said groove of said elongated support member; and said first and second arms of said first bracket are oriented to converge toward each other.

7. An apparatus according to claim 1, including:

a second bracket member for mating with and interconnecting with said elongated support member;

said second bracket member having a first portion thereof which is configured and dimensioned to fit within said groove of said elongated support member; and said first portion of said second bracket member having diametrically-opposed and oppositely-facing arcuate surfaces each of which surface conforms substantially to the shape of said arcuate wall portion of said groove of said elongated support member.

8. An apparatus according to claim 7, wherein:

said first portion of said second bracket member is provided with a threaded aperture extending therethrough.

* * * * *